US009682577B2

(12) United States Patent
Zhang et al.

(10) Patent No.: US 9,682,577 B2
(45) Date of Patent: Jun. 20, 2017

(54) PAPER STORAGE, PRINTER AND METHOD FOR USING MULTIPLE TYPES OF MEDIUMS

(71) Applicant: Shandong New Beiyang Information Technology Co., Ltd., Shandong (CN)

(72) Inventors: Jigang Zhang, Shandong (CN); Lin Long, Shandong (CN)

(73) Assignee: Shandong New Beiyang Information Technology Co., Ltd., Beijing (CN)

( * ) Notice: Subject to any disclaimer, the term of this patent is extended or adjusted under 35 U.S.C. 154(b) by 0 days.

(21) Appl. No.: 14/787,219

(22) PCT Filed: Apr. 24, 2014

(86) PCT No.: PCT/CN2014/076165

§ 371 (c)(1),
(2) Date: Oct. 26, 2015

(87) PCT Pub. No.: WO2014/177013

PCT Pub. Date: Nov. 6, 2014

(65) Prior Publication Data

US 2016/0082751 A1 Mar. 24, 2016

(30) Foreign Application Priority Data

May 2, 2013 (CN) ..... 2013 1 0158829

(51) Int. Cl.
*B41J 2/01* (2006.01)
*B41J 11/04* (2006.01)
(Continued)

(52) U.S. Cl.
CPC ..... *B41J 11/04* (2013.01); *B41J 15/042* (2013.01); *B65H 20/02* (2013.01); *B65H 29/20* (2013.01);
(Continued)

(58) Field of Classification Search
CPC ... B41J 11/04; B41J 11/20; B41J 11/32; B41J 2/325; B41J 3/36; B41J 35/03; B41J 35/20; B41J 35/28
See application file for complete search history.

(56) References Cited

U.S. PATENT DOCUMENTS 5,820,068 A * 10/1998 Hosomi ..... B26D 1/305 242/563
2011/0203467 A1 8/2011 Naito

FOREIGN PATENT DOCUMENTS

CN 1401497 A 3/2003
CN 201362041 Y 12/2009
(Continued)

OTHER PUBLICATIONS

International Search Report mailed on Jul. 29, 2014 in the International Application No. PCT/CN2014/076165 filed on Apr. 24, 2014, 2 pages.

*Primary Examiner* — Juanita D Jackson
(74) *Attorney, Agent, or Firm* — Wilmer Cutler Pickering Hale and Dorr LLP

(57) ABSTRACT

Disclosed are a paper storage and a printer. The paper storage comprises: a warehouse body (20) for accommodating a medium, a medium outlet (A), and a roller (5) arranged on the storage body (20), wherein the medium outlet (A) is configured to discharge the medium accommodated in the storage body (20) after the medium passes by the roller (5), and an opening (224) opposite to the roller (5) is also arranged on a wall of the storage body (20), to allow an external medium processing device to match with the roller (5) through the opening (224) to process the medium. To replace the paper storage in a printer adopting such paper storage, the need for respective detachment of various parts of the paper storage, and the need for opening of the upper cover of the printer to load the paper roll are eliminated,
(Continued)

thereby avoiding the problems of complex operations of replacing the paper roll and inconvenience in use.

14 Claims, 8 Drawing Sheets

(51) Int. Cl.

| | |
|---|---|
| ***B41J 15/04*** | (2006.01) |
| ***B65H 29/20*** | (2006.01) |
| ***B65H 35/00*** | (2006.01) |
| ***B65H 35/06*** | (2006.01) |
| ***B65H 20/02*** | (2006.01) |

(52) U.S. Cl.

CPC ..... *B65H 35/008* (2013.01); *B65H 35/06* (2013.01); *B65H 2301/41387* (2013.01); *B65H 2402/41* (2013.01); *B65H 2404/161* (2013.01); *B65H 2405/421* (2013.01); *B65H 2801/12* (2013.01)

(56) References Cited

FOREIGN PATENT DOCUMENTS

| | | | |
|---|---|---|---|
| CN | 102241202 | A | 11/2011 |
| CN | 202904755 | U | 4/2013 |
| CN | 203228509 | U | 10/2013 |
| JP | 2000108439 | A | 4/2000 |
| JP | 2005205732 | A | 8/2005 |
| WO | WO-2007111235 | A1 | 10/2007 |

* cited by examiner

PAPER STORAGE, PRINTER AND METHOD FOR USING MULTIPLE TYPES OF MEDIUMS

CROSS-REFERENCE TO RELATED APPLICATIONS

This application is a national stage application of International Application No. PCT/CN2014/076165, filed Apr. 24, 2014 which claims priority to Chinese patent application No. 201310158829.X, entitled "Paper Storage, Printer and Method for Using Multiple Types of Mediums" and filed on May 2, 2013 with the State Intellectual Property Office of China, the disclosure of which is incorporated therein by reference in its entirety.

TECHNICAL FIELD

The present disclosure relates to a paper storage, a printer adopting the paper storage, and a method for using multiple types of mediums.

BACKGROUND

The existing printer includes a printing mechanism and a paper storage fixedly connected with a frame, where a paper roll for printing is placed in the paper storage, and printing paper (i.e. a printing medium) may lead out from the paper roll to be printed by the printing mechanism and outputted to the outside of the printer. Due to the fact that a user needs to use different types of paper rolls depending on a specific case in some scenarios, there is a need for easy replacement of the paper roll in the printer, to improve the work efficiency.

International application Publication No. WO2007111235 provides a printer with a detachable paper storage. As shown in FIG. 1A, a printer 1' includes a body 2', an upper cover 3' and a paper storage 4' for accommodating printing paper, where the upper cover 3' is pivoted with side walls 14*a* and 15*a* of the body 2' and may be rotatably opened or closed relative to the body 2'. A printing head 21' is arranged in the body 2', and a roller 22' is arranged on the upper cover 3', so that when the upper cover 3' is closed relative to the body 2', the printing head 21' tangentially matches with the roller 22'.

A first space portion 34' is formed between the side walls 14*a* and 15*a* of the body 2', and a second space portion 35' is formed between side arms 32' and 33' of the upper cover 3'. The paper storage 4' is mounted in a space formed by the first space portion 34' and the second space portion 35'. The paper storage 4' includes a first part 4*a* and a second part 4*b*, where a first slot 45' and a second slot 46' of the second part 4*b* match with a first inserting pin 39' and a second inserting pin (not shown) on the body in a plugging manner, and a first inserting tab 40' and a second inserting tab 41' of the second part 4*b* match with the side walls 14*a* and 15*a* of the body 2' in a plugging manner; while clamping detents 51' and 52' of the first part 4*a* match with the two side arms of the upper cover 3' in a clamping manner, so that when the upper cover 3' is rotatably opened relative to the body 2', the first part 4*a* is accordingly opened. After the paper storage 4' is installed in the printer, as shown in FIG. 1B, a leading end of the printing paper is pulled out from the paper roll and then the upper cover 3' is closed, in this case, the printing paper is pressed between the roller 22' and the printing hear 21' and hence printing can be started. The printer can selectively adopt paper storages having different structural sizes to utilize paper rolls with different outer diameters.

However, the existing printer is defective in that: replacement by a paper roll with a different outer diameter requires for replacement by a paper storage having a different structural size, which requires for installing the first part and the second part of the paper storage respectively, and each time the paper roll is being installed, the upper cover is opened so as to pass the printing paper between the roller and the printing head, thus the operations of replacing the paper roll for such printer are complicated, causing inconvenience in use.

SUMMARY OF THE INVENTION

An object of the present disclosure is to provide a paper storage which is easy to replace and convenient in use. An object of the present disclosure is also to provide a printer adopting the paper storage. An object of the present disclosure is further to provide a method of using multiple types of mediums.

To this end, according to one aspect of the present disclosure, a paper storage is provided and includes: a storage body for accommodating a medium, a medium outlet, and a roller arranged on the storage body, where the medium outlet is configured to discharge the medium accommodated in the storage body after the medium passes by the roller, and an opening opposite to the roller is provided on a wall of the storage body, to allow an external medium processing device to match with the roller through the opening to process the medium.

Further, the paper storage includes a chassis and an upper cover, and the chassis and the upper cover are combined to form the medium outlet.

Further, the roller is arranged on the upper cover and the opening is arranged on the chassis.

Further, the paper storage also includes a paper tearing bar located at the medium outlet and arranged on the chassis.

Further, a guide member configured to limit a position of the medium in a width direction is arranged in the storage body.

Further, the paper storage also includes a clamping structure configured to lock the upper cover and the chassis together when the upper cover is closed relative to the chassis.

Further, the upper cover is pivoted with or detachably connected with the chassis.

Further, a gear in a transmission connection with a driving mechanism of the external medium processing device is arranged at an axial end of the roller.

Further, the paper storage also includes a connection structure configured to connect the storage body with the external medium processing device.

According to another aspect of the present disclosure, a printer is provided and includes: a base and a detachable paper storage as described above, where a printing head assembly is arranged on the base, and a roller of the paper storage is configured to match with a printing head of the printing head assembly at an opening of the paper storage.

Further, the base is provided with a driving mechanism configured to drive the roller to rotate.

Further, the base is provided with a concave portion configured to position the paper storage.

Further, a clamping structure configured to clamp the paper storage and the base together is arranged between the paper storage and the base.

Further, a locking mechanism configured to lock the paper storage is further arranged on the base, and the locking mechanism includes a lock hook configured to match with a core shaft of the roller on the paper storage in a locking manner.

Further, a first elastic element declining toward the paper storage is arranged in the concave portion so that the paper storage always trends to move away from the concave portion.

According to yet another aspect of the present disclosure, a printer is provided and includes: a base and a paper storage detachably connected with the base, where the paper storage includes a chassis and an upper cover which are pivoted with each other through a pivot shaft, where the upper cover is rotatable to be opened or closed relative to the chassis, a roller is arranged on the upper cover, and an opening is arranged on the chassis; a printing head assembly, a driving mechanism configured to drive the roller to rotate, and a concave portion configured to accommodate the paper storage are arranged on the base; a clamping slot configured to clamp the pivot shaft is arranged in the concave portion, and a lock hook configured to lock the core shaft of the roller is arranged on the chassis; and a space configured to accommodate a medium is formed between the upper cover and the chassis when the upper cover is closed relative to the chassis, and the roller matches with a printing head of the printing head assembly at the opening.

The present disclosure also provides a method of using multiple types of mediums including: providing a medium processing system comprising a medium processing device and a plurality of paper storages, and to utilize a different type of medium, combining the paper storage accommodating the type of medium with a base of the medium processing device, wherein the medium is outputted from a medium outlet of the paper storage after passing by a roller of the paper storage, and the medium processing device matches with the roller via an opening of the paper storage to process the medium.

Further, the medium processing system is a printing system, and the medium processing device is a printer.

When the paper storage of the present disclosure is installed on the base of the printer, before the medium in the paper storage is outputted from the medium outlet of the paper storage after passing by the paper storage, the medium is sandwiched between the printing head of the printer and the roller at the opening of the paper storage, is printed by the printing head and then extrudes from the paper storage via the medium outlet of the paper storage. The paper storage can be wholly removed from the printer to detach the paper storage. Therefore, compared with the prior art, the printer adopting the paper storage of the present disclosure eliminates, in replacing the paper storage, the need for respective detachment of various parts of the paper storage and the need for opening of an upper cover of the printer to load the paper roll, thus the problem of the complicated operations of replacing the paper roll and inconvenience in use is avoided.

In addition to the above objects, features and advantages, other objects, features and advantages of the present disclosure will be further described in detail in combination with the accompanying drawings.

BRIEF DESCRIPTION OF THE DRAWINGS

Accompanying drawings, which construct a part of the specification and are used for better understanding of the present disclosure, illustrate some preferred embodiments of the present disclosure, and show principles of the present disclosure in combination with the description below.

Figure 1A:
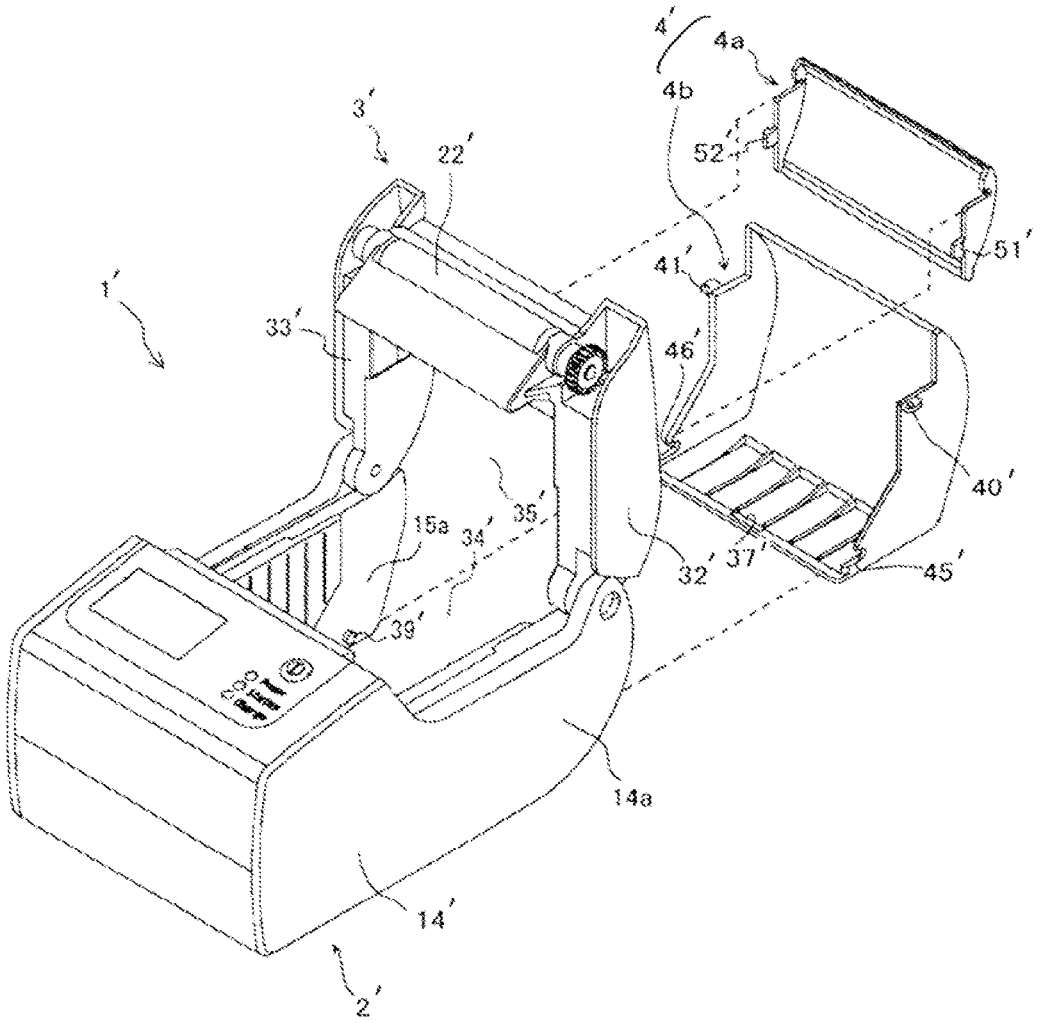
Fig. 1A (Prior Art)
FIG. 1A is a structural view of a printer adopting a detachable paper storage provided in International Application Publication No. WO2007111235.
Figure 1B:
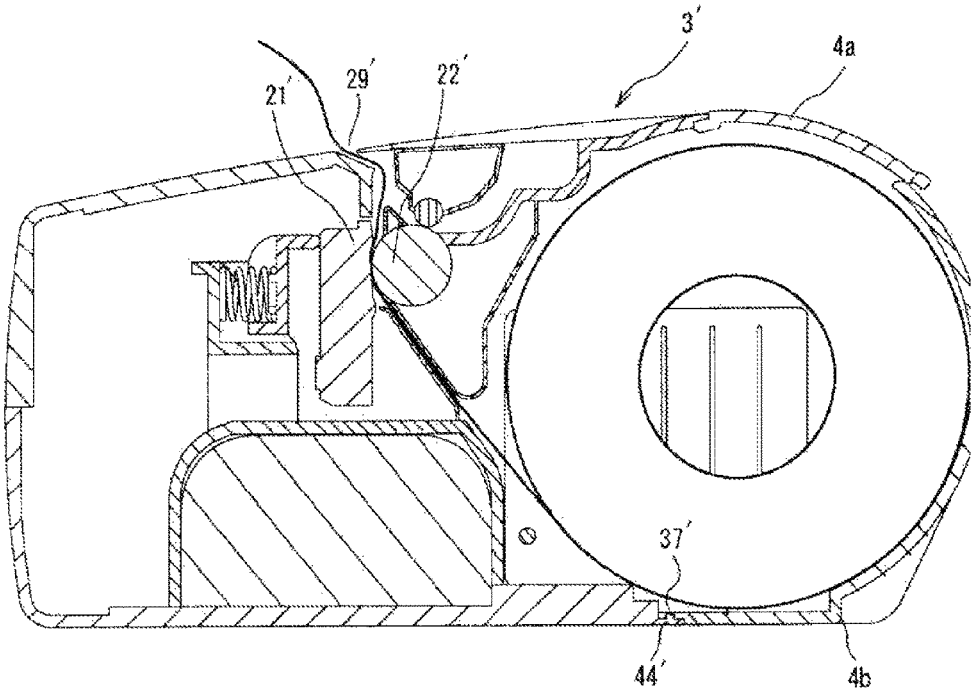
Fig. 1B (Prior Art)
FIG. 1B is a structural section view of the printer shown in FIG. 1A.

| List of reference numerals | |
|---|---|
| 1. Base | 2. Paper storage |
| 4. Printing head assembly | 5. Roller |
| 7. Elastic hook | 8. Elastic slice |
| 11. Left wall | 12. Right wall |
| 13. Upper casing | 14. Bottom casing |
| 15. Bracket | 16. Notch |
| 17. Concave portion | 20. Storage body |
| 21. Upper cover | 22. Chassis |
| 23. Paper tearing bar | 24. Clamping hook |
| 25. Guide member | 31. Third connection member |
| 32. Fourth connection member | 33. Clamping part |
| 34. Clamping slot | 41. Printing head |
| 42. Second elastic element | 43. Support plate |
| 51. Core shaft | 52. Roller wheel |
| 53. Gear | 211. Pivot shaft |
| 221. Left side wall | 222. Right side wall |
| 223. Bottom board | 224. Opening |
| 225. Inserting slot | 312. Clamping member |
| 321. Rotation shaft | 322. Locking hook |
| 323. Third elastic element | 324. Button |

DETAILED DESCRIPTION OF THE EMBODIMENTS

Embodiments of the present disclosure are described in detail below in combination with the accompanying drawings, although the present disclosure can be implemented in various ways defined and covered by the appended claims.

Figure 2:
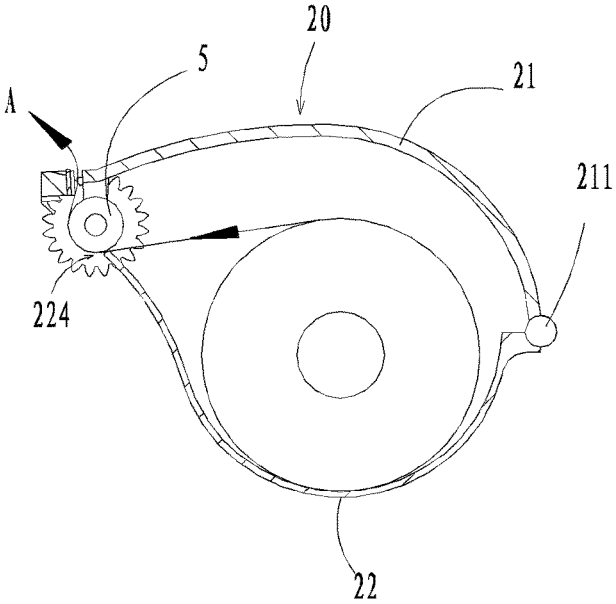
FIG. 2 is a structural section view of a paper storage according to a first embodiment of the present disclosure.
Figure 3A:
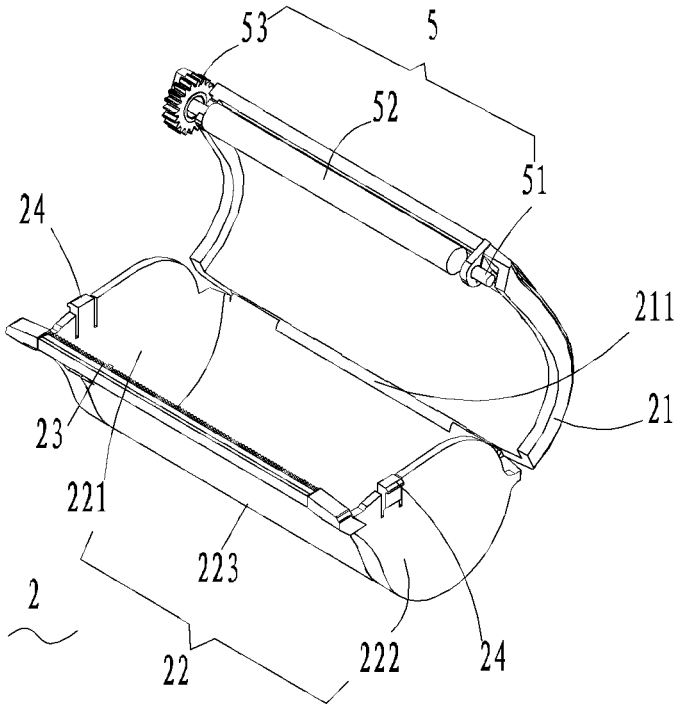
FIG. 3A is a first isometric view of the paper storage according to the first embodiment of the present disclosure, where the upper cover is opened.
Figure 3B:
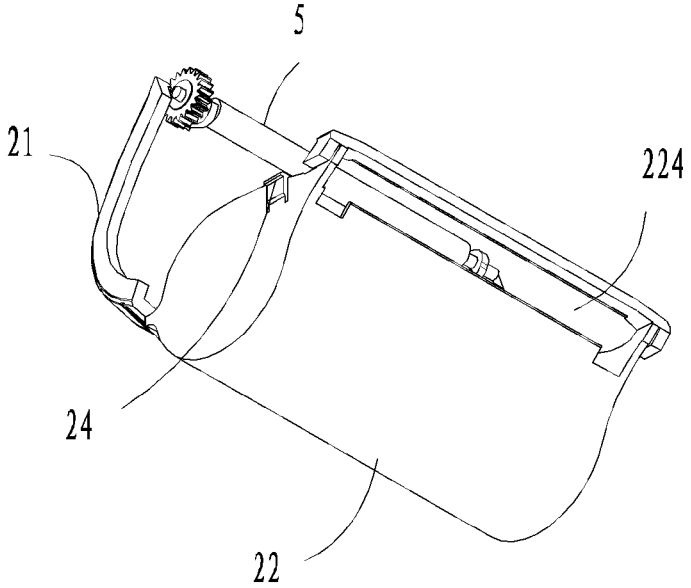
FIG. 3B is a second isometric view of the paper storage according to the first embodiment of the present disclosure, where the upper cover is opened.
Figure 4:
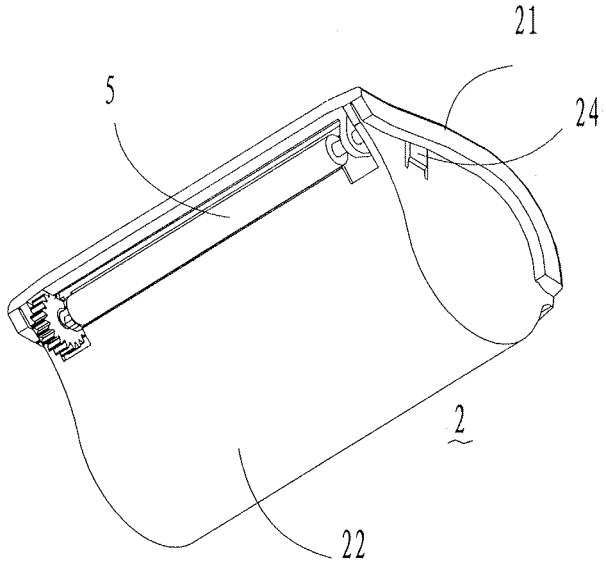
FIG. 4 is an isometric structural view of the paper storage according to the first embodiment of the present disclosure, where the upper cover is closed.

FIG. 2 is structural section view of a paper storage according to a first embodiment of the present disclosure, FIG. 3A is a first isometric view of the paper storage according to the first embodiment of the present disclosure where the upper cover is opened, FIG. 3B is a second isometric view of the paper storage according to the first embodiment of the present disclosure where the upper cover is opened, and FIG. 4 is an isometric structural view of the paper storage according to the first embodiment of the present disclosure, where the upper cover is closed. As shown in FIGS. 2, 3A, 3B and 4, a paper storage 2 includes a storage body 20 and a roller 5 arranged on the storage body 20, where the storage body 20 is provided with a medium outlet A and an opening 224 that is opposite to the roller 5.

The storage body 20 includes an upper cover 21 and a chassis 22, which are combined in such a way that the medium outlet A is formed. The chassis 22 includes a left side wall 221, a right side wall 222 and a bottom board 223, where the left side wall 221 and the right side wall 222 are arranged in parallel to each other, a distance between an inner surface of the left side wall 221 and an inner surface of the right side wall 222 matches with the maximum width of a paper roll, and the bottom board 223 is connected perpendicularly between the left side wall 221 and the right side wall 222. Preferably, the bottom board 223 has a cross section of an arc shape having a radius matching with the maximum radius of the paper roll. The bottom board 223 is provided with the opening 224, which has a longitudinal direction extending along a width direction of the paper roll and has a preset width. In other embodiments of the present disclosure, the bottom board 223 may have a cross section of a trapeziform or rectangular shape.

The upper cover 21 is pivoted with or connected detachably with the chassis 22. In the present embodiment, the upper cover 21 is pivoted with the chassis 22 through a pivot shaft 211, and may be rotatably opened or closed relative to the chassis 22. The pivot shaft 211 is located at a side of the chassis 22 away from the opening 224, and has an axis extending in a direction perpendicular to the left side wall 221 and the right side wall 222. When the upper cover 21 is closed, a space accommodating the paper roll is formed by the upper cover 21 and the chassis 22, and the paper roll rolls freely in the space. In this case, a side of the upper cover 21 away from the pivot shaft 211 is opposite to a side of the chassis 22 away from the pivot shaft 211 and is apart from side of the chassis 22 away from the pivot shaft 211 by a predefined distance to form the medium outlet A.

The roller 5 is arranged at a side of the upper cover 21 away from the pivot shaft 211 and has an axis parallel to the axis of the pivot shaft 211. The roller 5 includes a core shaft 51, a roller wheel 52, and a gear 53, where the core shaft 51 has an axis parallel to the axis of the pivot shaft 211, and is supported on the upper cover 21 at its both ends, so that the core shaft 51 is rotatable about its own axis. The roller wheel 52 is fixedly arranged on the periphery of the core shaft 51 and extends along the axial direction of the core shaft 51. The roller wheel 52 has a length larger than the width of the printing paper, and may be made of elastic material such as rubber or plastic. When the core shaft 51 is rotated, the roller wheel 52 is rotated synchronously with the core shaft 51. When the upper cover 21 is closed, the roller wheel 52 is opposite to the opening 224 on the chassis 22, in this case, the roller wheel 52 may be located within the chassis 22, or may pass through the opening 224 on the chassis 22 to be exposed at the external of the paper storage 2. The gear 53 is fixedly installed on one end of the core shaft 51, and is transmission connected with a driving mechanism of the printer when the paper storage 2 is installed in the printer. When the gear 53 is driven to rotate by the driving mechanism of the printer, the gear 53 causes the core shaft 51 to rotate, and the roller wheel 52 rotates accordingly.

The paper storage 2 also includes a locking assembly, which is configured to fix the upper cover 21 at a locked position where the upper cover 21 is closed relative to the chassis 22. In the present embodiment, the locking assembly is embodied as a clamping structure including a clamping hook 24 and a clamping slot (not shown), where the clamping hook 24 is located on one of the chassis 22 and the upper cover 21, and the clamping slot is located on the other of the chassis 22 and the upper cover 21. When the upper cover 21 is closed, the clamping hook 24 matches with the clamping slot in a clamping manner, so that the upper cover 21 is fixed at the locked position for closing. When a user pushes the clamping hook 24, the clamping hook 24 is separated from the clamping slot so that the upper cover 21 is opened. In the present embodiment, the paper storage 2 includes two locking assemblies, which are symmetrically arranged with respect to a middle line between the left side wall 221 and the right side wall 222 of the chassis 22 in the width direction, where two clamping hooks 24 are located at inner sides of the left side wall 221 and the right side wall 222 of the chassis 22, respectively, and two clamping slots are located on two side walls of the upper cover 21. Thus, when the upper cover 21 is closed, the two clamping hooks 24 match with the two clamping slots in a clamping manner, so that the upper cover 21 is fixed at the locked position for closing; and to open the upper cover 21, the clamping hooks 24 are pushed from both sides and hence are separated from the clamping slots, thereby opening the upper cover 21.

It is noted that in other embodiments of the present disclosure, the locking assembly may include a lock hook and a lock shaft, where the lock hook is pivoted with one of the upper cover 21 and the chassis 22 through a rotation shaft and is rotatable about an axis of the rotation shaft, while the lock shaft is arranged on the other of the upper cover 21 and the chassis 22, thus, when the upper cover 21 is closed relative to the chassis 22, the lock hook matches with the lock shaft in a clamping manner to fix the upper cover 21 at the locked position for closing, and when the lock hook is separated from the lock shaft, the upper cover 21 is allowed to be opened relative to the chassis 22.

The paper storage 2 further includes a connection structure configured to connect the paper storage 2 with the printer. In the present embodiment, the connection structure is a first connection mechanism including a first connection member and a second connection member. Preferably, the first connection member is located at an end of the chassis 22 away from the opening 224, and the second connection member is located at an end of the chassis 22 close to the opening 224. Here, the first connection member may be a clamping part or a clamping slot arranged at the outer side of the bottom board 223 of the chassis 22 of the paper storage 2 or at the outer sides of the left side wall 221 and the right side wall 222 of the chassis 22. When the first connection member is the clamping part, the clamping slot is correspondingly arranged on the printer, and when the first connection member is the clamping slot, the clamping part is correspondingly arranged on the printer, so that the clamping slot matches with the clamping part in a clamping manner. The second connection part may be the lock shaft or the lock hook arranged on the outer sides of the left side wall 221 and the right side wall 222 of the chassis 22, thus, when the second connection part is the lock shaft, the lock hook is correspondingly arranged on the printer, and when the second connection part is the lock hook, the lock shaft is correspondingly arranged on the printer, so that the lock hook matches with the lock shaft in a locking manner. Therefore, the paper storage 2 is fixedly connected with the printer through the first connection member and the second connection member.

In the present embodiment, the first connection member is a pivot shaft 211 and the second connection member is the core shaft 51 of the roller 5. When the paper storage is installed in the printer, the core shaft 51 of the roller 5 matches with the lock hook arranged on the printer in a locking manner, to facilitate limiting the relative position of the roller 5 and the printing head of the printer. In other embodiments of the present disclosure, the lock shaft is alternatively arranged on the side wall of the chassis 22, so that the lock shaft matches with the lock hook arranged on the printer in a locking manner. Therefore, the upper cover 21 of the paper storage 2 may be directly opened to replace the paper roll when the paper storage is installed in the printer, thereby simplifying the operation steps of replacing the paper roll.

Preferably, the paper storage 2 also includes a paper tearing bar 23 of a slice shape located at the medium outlet A, and the paper tearing bar 23 may be fixedly installed on the chassis 22 or the upper cover 21. By pulling the printing paper forcibly, the printing paper will be torn by the blade of the paper tearing bar 23. In the present embodiment, the paper tearing bar 23 is fixedly installed on the chassis 22.

In installing the paper roll, the upper cover 21 is firstly opened, then the paper roll is placed in the chassis 22, a leading end of the printing paper is drawn out from the paper storage, and finally the upper cover 21 is closed so that the clamping hook 24 on the chassis 22 matches with the clamping slot on the upper cover 21 in a clamping manner, thereby accomplishing the installing of the paper roll. In this case, the printing paper passes by the roller wheel 52 of the roller 5 and is exposed at the opening 224 of the chassis 22, and the leading end of the printing paper is led out from the medium outlet A of the paper storage 2.

In the paper storage provided in the present embodiment, the upper cover is pivoted with the chassis and the roller is arranged on the upper cover, so that after the paper roll is installed in the paper storage, the printing paper is discharged from the medium outlet after passing by the roller, and meanwhile the printing paper is exposed at the opening of the chassis. When the paper storage is installed on the printer, the roller on the paper storage matches with the printing head of the printer at the opening of the paper storage, and the printing paper is sandwiched between the roller and the printing head so that printing can be performed on the printing paper by the printing head. To detach the paper storage, the paper storage can be as a whole removed from the printer. Therefore, compared with the prior art, the printer adopting the paper storage of the present disclosure eliminates, in replacing the paper storage, the need for respective detachment of various parts of the paper storage and the need for opening of an upper cover of the printer to load the paper roll, thus the problem of the complicated operations of replacing the paper roll and inconvenience in use is avoided.

It is noted that, in the above embodiment, the upper cover of the storage body is turned over to be opened or closed relative to the chassis in a front-and-rear direction. When the upper cover is closed, the storage body for accommodating the medium is formed by the upper cover and the chassis, and the medium outlet is opposite to the pivoting position. In other embodiments, the upper cover may be laterally turned over to be opened relative to the chassis in a left-and-right direction, and in this case, the medium outlet is located at the side of the pivot shaft on the upper cover. Alternatively, the storage body may be formed in another way or by other parts, without being limited to the upper cover and the chassis as well as the pivot connection between the upper cover and the chassis.

It is noted that, in the above embodiment, the roller is exposed at the opening of the paper storage and is tangential to the printing head. In other embodiments, the printing head may enter into the paper storage through the opening of the paper storage to tangentially match with the roller.

It is noted that, in the above embodiment, the chassis 22 and the upper cover 21 are combined to form the medium outlet A. In other embodiments, an opening may be provided on the surface of the upper cover 21 to form the medium outlet.

Figure 5:
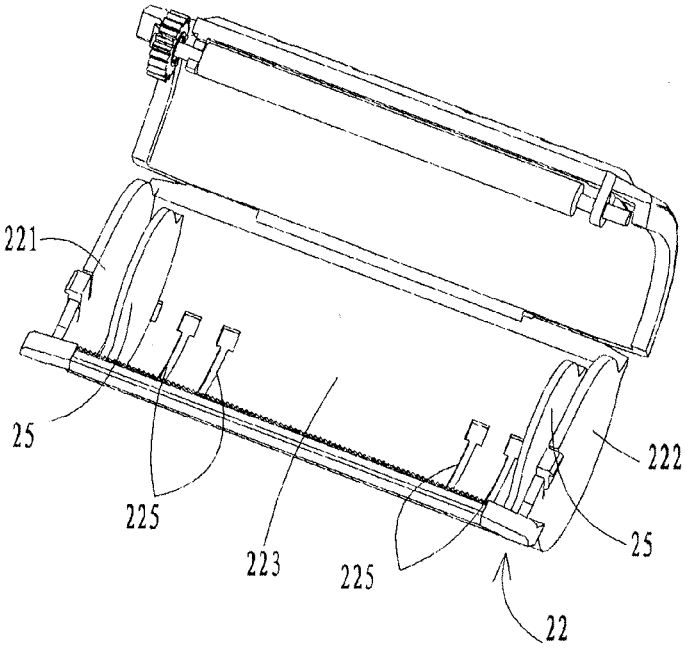
FIG. 5 is an isometric structural view of the paper storage according to a second embodiment of the present disclosure, where the upper cover is closed.

FIG. 5 is an isometric structural view of the paper storage according to a second embodiment of the present disclosure, where the upper cover is closed. As shown in FIG. 5, the second embodiment is different from the previous embodiment in that: the paper storage 2 further includes at least one guide member 25 in the present embodiment, and accordingly at least one inserting slot 225 for installing the guide member 25 is arranged on the bottom board 223 of the chassis 22.

Here, the guide member 25 is configured to adjust the width of the paper storage 2, limit the movement of the paper roll placed in the paper storage 2 in an axial direction of the paper roll, and hence prevent the deflected movement of the printing paper. The number of the guide members 25 depends on the alignment manner of the printing paper. When the printing paper is aligned by using one side of the paper storage as a reference plane, one guide member 25 is included in the paper storage 2, and accordingly several inserting slots 225 are provided on the bottom board 223 of the chassis 22 in the width direction of the paper roll, so that when the guide member 25 is inserted into one of the several inserting slots 225, a distance between the guide member 25 and the reference plane matches with the width of a certain type of paper roll, thus, the guide member 25 is inserted into the corresponding inserting slot 225 depending on the width of the paper roll in use. When the printing paper is aligned with reference to a center line of the paper storage 2 in the width direction, two guide members 25 are included in the paper storage 2, and accordingly several inserting slots 225 are provided on the bottom board 223 of the chassis in the width direction of the paper roll, where the inserting slots 225 are divided into groups, each of which includes two inserting slots 225 arranged symmetrically with respect to the center line of the paper storage 2 in the width direction, and a distance between the inserting slots 225 of each group matches with the width of a certain type of paper roll, thus, the two guide members 25 are respectively inserted into the corresponding inserting slots 225 depending on the width of the paper roll in use.

In the present embodiment, the printing paper is aligned with reference to the center line of the paper storage 2 in the width direction, and hence there are two guide members 25, which match with the corresponding inserting slots 225 on the bottom board 223 in a plugging manner and are both parallel to the left side wall 221 and the right side wall 222, so that the two guide members 25, together with the bottom board 223 of the chassis 22, form a paper accommodating space, and the movement of the paper roll in the paper accommodating space along the axial direction of the paper roll is eliminated. Therefore, the paper storage provided in the present embodiment is applicable to paper rolls of different widths, and hence has improved adaptability to mediums.

Figure 6:
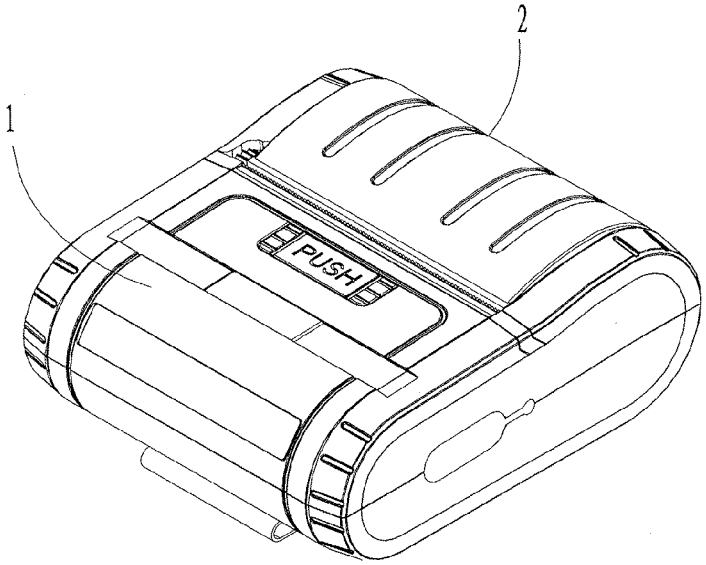
FIG. 6 is a structural view of a printer according to a first embodiment of the present disclosure.
Figure 7:
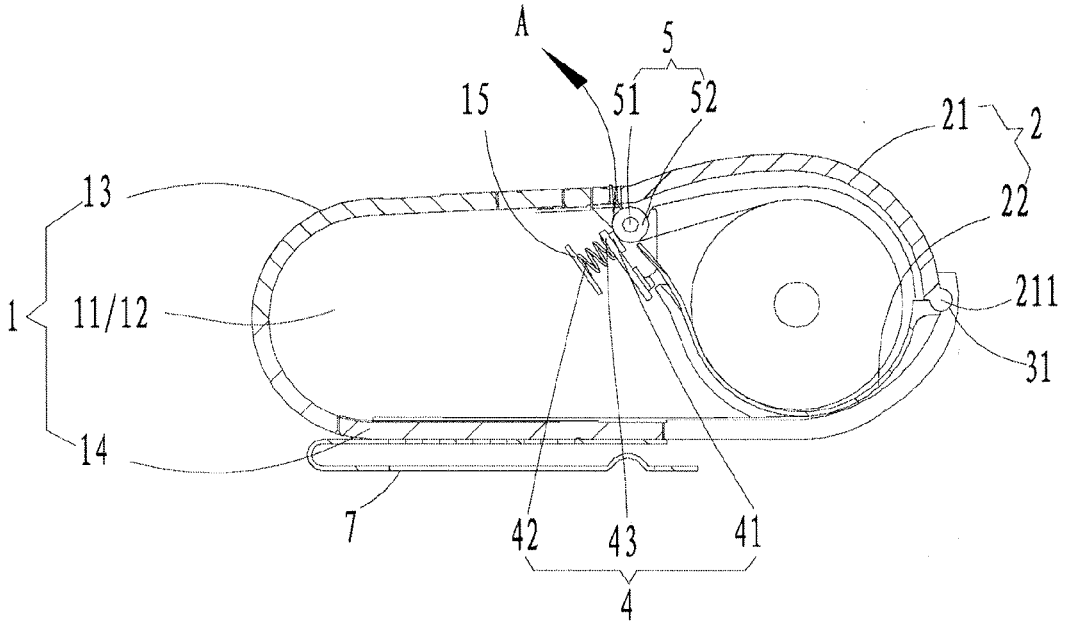
FIG. 7 is a structural section view of the printer according to the first embodiment of the present disclosure.
Figure 8:
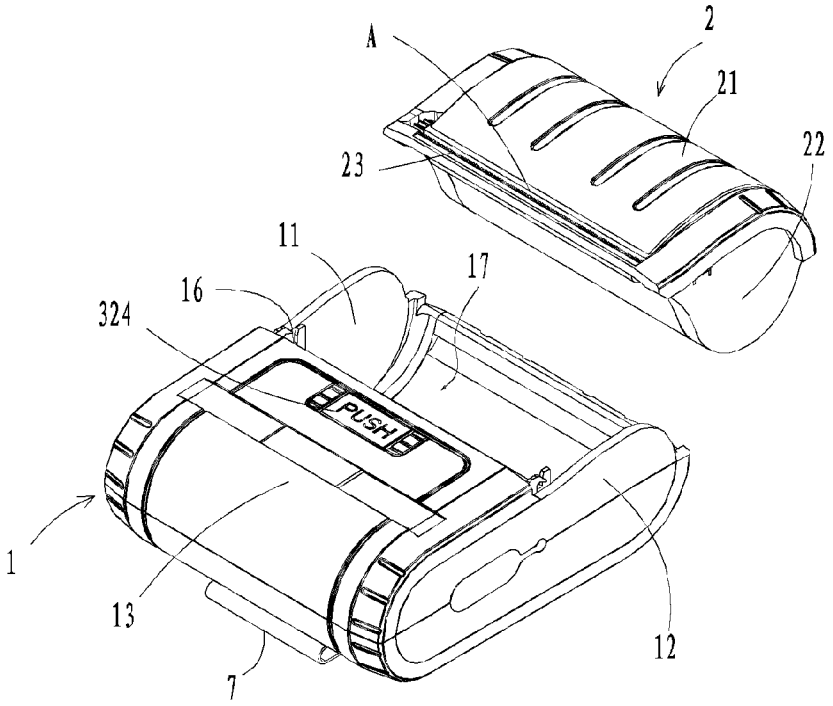
FIG. 8 is a structural view of the printer according to the first embodiment of the present disclosure, where the paper storage is separate from a base of the printer.

FIG. 6 is a structural view of a printer according to the first embodiment of the present disclosure, FIG. 7 is a structural section view of a printer according to the first embodiment of the present disclosure, and FIG. 8 is a view of the printer according to the first embodiment of the present disclosure, where the paper storage is separate from a base of the printer. As shown in FIG. 6, FIG. 7 and FIG. 8, a printer includes a base 1, a paper storage 2, a printing head assembly 4, and a second connection mechanism. The printing head assembly 4 and the second connection mechanism are both arranged on the base 1, and the paper storage 2 is one of those paper storages described in the above embodiments and is detachably connected with the base 1. After the paper storage 2 is connected with the base 1, the roller 5 on the paper storage 2 tangentially matches with the printing head 41 of the printing head assembly 4 at the opening of the paper storage.

As shown in FIG. 8, the base 1 includes a left wall 11, a right wall 12, and a bottom casing 14. The left wall 11 and the right wall 12 are parallel to each other and are spaced by a predefined distance, and a distance between an inner surface of the left wall 11 and an inner surface of the right wall 12 matches with the width of the paper storage 2. The bottom casing 14 is connected between the left wall 11 and the right wall 12, and has a cross section of a shape matching with the shape of the cross section of the chassis 22 of the paper storage 2. The left wall 11, the right wall 12 and the bottom casing 14 form a concave portion 17 configured to position and accommodate the paper storage 2.

Preferably, the base 1 further includes an upper casing 13 located between the left wall 11 and the right wall 12 and above the bottom casing 14, and the upper casing 13 is opposite to a portion of the bottom casing 14. The concave portion 17 is located at a side of the bottom casing 14 not opposite to the upper casing 13. Preferably, the base 1 further includes a bracket 15 connected perpendicularly to both the left wall 11 and the right wall 12 and located between the upper casing 13 and the bottom casing 14.

The printing head assembly 4 is arranged on the base 1, and is located at the downstream of the concave portion 17 in a printing paper transmission direction. The printing head assembly 4 includes a printing head 41, at least one second elastic element 42, and a support plate 43. The support plate 43 is movably connected with the bracket 15 of the base 1, and the printing head 41 is fixedly connected with the support plate 43 and located at a side of the support plate 43 away from the bracket 15. The second elastic element 42, which may be a pressure spring, a torsion spring or a plate spring, is located between the support plate 43 and the bracket 15, and has one end connected with the support plate 43 and the other end connected with the bracket 15. Under the effect of an elastic force applied by the second elastic element 42, the support plate 43 and hence the printing head 41 always trend to move into the concave portion 17. The base 1 is also provided with a positioning member (not shown) matching with the support plate 43, and the support plate 43 of the printing head assembly 4 can be stabilized at a position distant from the bracket 15 by a predefined distance under the limitation by the positioning member.

Preferably, the printer further includes an elastic hook 7 arranged at the outer side of the bottom casing 14 and configured to hang the printer on a waist belt of the user for ease carry.

Preferably, notches 16 are symmetrically arranged on the inner sides of the left wall 11 and the right wall 12 of the base 1, and openings of the notches 16 are respectively arranged at a side of the left wall 11 and a side of the right wall 12 that are away from the bottom casing 14. The notch 16 has a width matching with a diameter of the core shaft 51 of the roller 5 of the paper storage 2, has a length direction extending in an upper-and-down direction, and has a depth direction extending in a thickness direction of the walls. Preferably, the notch 16 has a tapered shape, to smoothly guide the core shaft 51 of the roller 5 into the notch 16.

Figure 9:
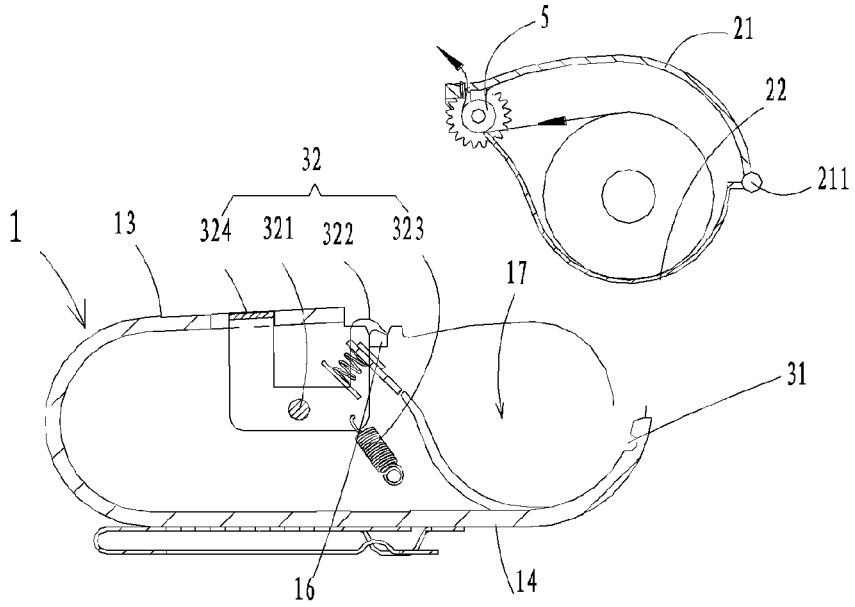
FIG. 9 is a first view of installing of the paper storage into the printer according to the first embodiment of the present disclosure.
Figure 10:
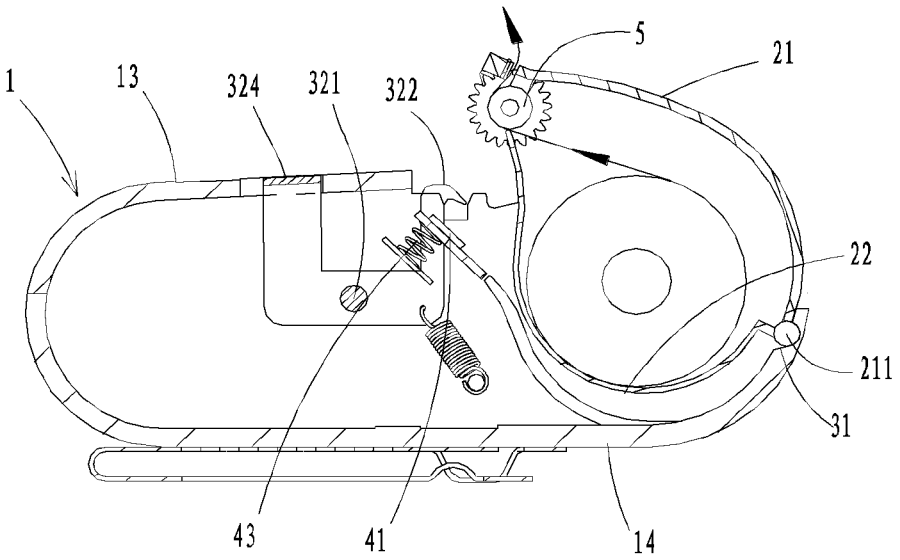
FIG. 10 is a second view of installing of the paper storage into the printer according to the first embodiment of the present disclosure.

The second connection mechanism is arranged on the base 1, and is configured to connect to the first connection mechanism on the paper storage 2, so that the paper storage 2 and the base 1 are detachably connected. FIG. 9 is a first view of installing of the paper storage into the printer according to the first embodiment of the present disclosure, and FIG. 10 is a second view of installing of the paper storage into the printer according to the first embodiment of the present disclosure. As shown in FIG. 9 and FIG. 10, the second connection mechanism includes a third connection member 31 and a fourth connection member 32.

The third connection member 31 matches with the first connection member of the first connection mechanism on the paper storage 2. When the first connection member is arranged on the bottom board 223 of the paper storage 2, the third connection member 31 is arranged on the inner side of the bottom casing 14 of the base 1, and when the first connection member is arranged on the outer sides of the left side wall 221 and the right side wall 222 of the paper storage 2, the third connection member 31 is correspondingly arranged on the inner sides of the left wall 11 and the right wall 12 of the base 1. When the paper storage 2 is installed on the base 1, the first connection member and the third connection member 31 match with each other in a clamping manner.

In the present embodiment, the first connection member is embodied by the pivot shaft 211, and the third connection member 31 is arranged on the inner side of the bottom casing 14 and has a groove shape. The third connection member 31 has a depth extending in the thickness direction of the walls, a length extending in a direction perpendicular to the left wall 11 and the right wall 12, and a cross section of a shape matching with the shape of the cross section of the pivot shaft 211. When the paper storage 2 is installed on the base 1, the paper storage 2 is located in the concave portion, and the pivot shaft 211 on the paper storage 2 is clamped in the third connection member 31 on the bottom casing 14, thereby limiting the movement of a side of the paper storage 2 close to the pivot shaft 211 toward the top and rear of the bottom cashing 14.

The fourth connection member 32 is configured to match with the second connection member on the paper storage 2. When the second connection member is embodied as the lock shaft, the fourth connection member 32 includes a lock hook 322, and when the second connection member is embodied as the lock hook, the fourth connection member 32 is the lock shaft. In the present embodiment, the second connection member is the core shaft 51 of the roller 5, and the fourth connection member 32 includes the lock hook 322, a rotation shaft 321, a third elastic element 323 and a button 324. The rotation shaft 321 is supported by the left wall 11 and the right wall 12 of the base 1, the lock hook 322 is pivoted with the base 1 through the rotation shaft 321, where the lock hook 322 may be fixedly connected with the rotation shaft 321 and hence may be rotated synchronously with the rotation shaft 321, or alternatively, the rotation shaft 321 may be sheathed in the lock hook 322 so that the lock hook 322 may be rotated about the rotation shaft 321.

When the pivot shaft 211 of the paper storage 2 matches with the third connection member 31 of the base 1 in a clamping manner, the lock hook 322 may match with the core shaft 51 of the roller 5 in a clamping manner, to fix the position of the paper storage 2 relative to the base 1. The third elastic element 323 has one end connected with the lock hook 322 and the other end connected with the base 1. Under the effect of an elastic force applied by the third elastic element 323, the lock hook 322 always trend to clamp and lock the core shaft 51 of the roller 5. The button 324 is fixedly connected with the lock hook 322 and located at the outside of the base 1, and triggering or pressing the button 324 by the user can cause the rotation of the lock hook 322, so that the lock hook 322 is separated from the core shaft 51 of the roller 5, thereby allowing detachment of the paper storage 2 from the base 1.

Specifically the fourth connection member 32 in the present embodiment includes two lock hooks 322 which are integrated and fixedly connected with both ends of the rotation shaft 321, respectively. The rotation shaft 321 is supported by the left wall 11 and the right wall 12 of the base 1, and these two lock hooks 322 are rotatable about the axis of the rotation shaft 321 synchronously with the rotation shaft 321. The third elastic element 323 has one end connected with the base 1 and the other end connected with the lock hooks 323. The button 324, which is located at the outside of the upper casing 13 of the base 1, is connected with an intermediate portion between the two lock hooks 322. When the pivot shaft 211 of the paper storage 2 matches with the third connection member 31 on the base 1 in a clamping manner, the lock hooks 322 match with the core shaft 51 of the roller 5 in a clamping manner, to fix the position of the paper storage 2 relative to the base 1. When the user triggers or presses the button 324, the button 324 causes the rotation of the lock hooks 322, so that the lock hooks 322 are separated from the core shaft 51 of the roller 5, thereby allowing detachment of the paper storage 2 from the base 1.

The procedure of replacing the paper storage in the printer is described below.

To install the paper storage 2, the pivot shaft 211 of the paper storage 2 is firstly clamped in the third connection member 31 on the base 1, and then the paper storage 2 is rotated about the pivot shaft 211 so that the paper storage 2 is rotated to approach the printing head 41. When the paper storage 2 entirely enters into the concave portion 17, the paper storage 2 is pressed so that the core shaft 51 of the roller 5 on the paper storage 2 pushes the lock hook 322 to rotate by overcoming the elastic force applied by the third elastic element 323. When the chassis 22 of the paper storage 2 contacts and matches with the bottom casing 14 of the base 1, the lock hook 323 matches with the core shaft 51 in a clamping manner under the effect of the elastic force applied by the third elastic element 323, in this way, one end of the paper storage 2 matches with the lock hook 322 in a clamping manner through the core shaft 51 of the roller 5, and the other end of the paper storage 2 matches with the clamping member 312 on the base 1 in a clamping manner through the pivot shaft 211, so that the position of the paper storage 2 relative to the base 1 is fixed. Meanwhile, the roller wheel 52 of the roller 5 is tangential to the printing head 41 at the opening of the paper storage, with the printing paper passing through the roller 5 and the printing head 41.

To detach the paper storage 2, firstly the button 324 is triggered or pressed, so that the lock hook 322 is rotated to be detached from the core shaft 51 of the roller 5 and the paper storage 2 can be rotated about the pivot shaft 211, then the paper storage 2 is rotated to be away from the printing head 41, and the pivot shaft 211 on the paper storage 2 is detached from the third connection member 31 on the base 1, thereby detaching the paper storage 2 from the base 1 of the printer.

In the use of the printer in the present disclosure, after the paper storage is installed in the paper storage, the printing paper passes by the roller of the paper storage and is exposed at the opening of the paper storage, and the user is allowed to select a paper storage accommodating a corresponding type of paper roll depending on a specific case. The installing and replacing of the paper storage only requires for the matching between the first connection member on the paper storage and the third connection member on the base and between the second connection member on the paper storage and the fourth connection member on the base, as such, the paper storage is locked at a fixed position relative to the base, in this case, the roller of the paper storage tangentially matches with the printing head at the opening of the paper storage, the printing paper within the paper storage is sandwiched between the roller of the paper storage and the printing head at the opening of the paper storage, and printing can be performed on the printing paper by the printing head. Meanwhile, the paper storage can be wholly removed from the printer to detach the paper storage. Therefore, compared with the prior art, the printer in the present disclosure eliminates the need for opening of the upper cover of the printer to load the paper during the replacement of the paper storage and the need for respective detachment of various parts of the paper storage, thus the operations are simplified, and the work efficiency on site is improved.

It is noted that, in the above embodiments, the paper storage is installed on the base through the clamping structure and the locking mechanism. In another embodiment, the user is allowed to press the paper storage into the concave portion by a finger to implement the printing by the paper storage, in this case, the provision of the clamping structure and/or the locking mechanism is eliminated. In still another embodiment, the paper storage and the base match with each other in position by means of an external bracket.

It is noted that the printing head on the base may be replaced by other processing devices such as a scanning head.

Figure 11:
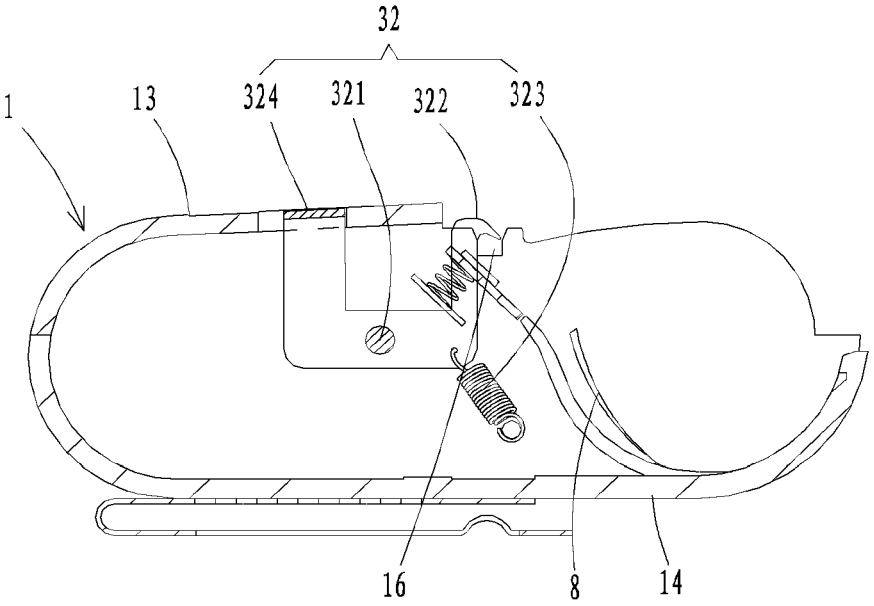
FIG. 11 is a partial structural section view of a printer according to a second embodiment of the present disclosure.

FIG. 11 is a partial structural section view of the printer according to a second embodiment of the present disclosure. As shown in FIG. 11, the present embodiment differs from the preceding embodiment in that: a first elastic element declining toward the paper storage 2 is arranged in the concave portion 17 of the base 1 in the present embodiment, so that the paper storage always trends to move away from the concave portion, where one end of the first elastic element is connected with the concave portion 17 and the other end of the first elastic element is suspended. In the present embodiment, the first elastic element is an elastic slice 8. In other embodiments, the first elastic element may be of other structural forms such as a pressure spring.

In installing the paper storage 2, after the pivot shaft 211 on the paper storage 2 matches with the third connection member 31 on the base 1 in a clamping manner, the paper storage 2 is pressed against the elastic force applied by the elastic slice 8, meanwhile the lock hook 322 is driven against the elastic force applied by the third elastic element 323, until the lock hook 322 matches with the core shaft 51 of the roller 5 in a clamping manner. In detaching the paper storage 2, the button 324 is pressed so that the paper storage 2 is automatically rotated about the pivot shaft 211 under the effect of the elastic force applied by the elastic slice 8, thus the front end of the paper storage 2 is lifted up and hence the paper storage 2 can be easily removed.

With the arrangement of the elastic slice in the base in the present embodiment, when the button is pressed to detach the paper storage, the elastic lice can automatically lift up the paper storage, thereby further simplifying the operation steps of replacing the paper storage.

Figure 12:
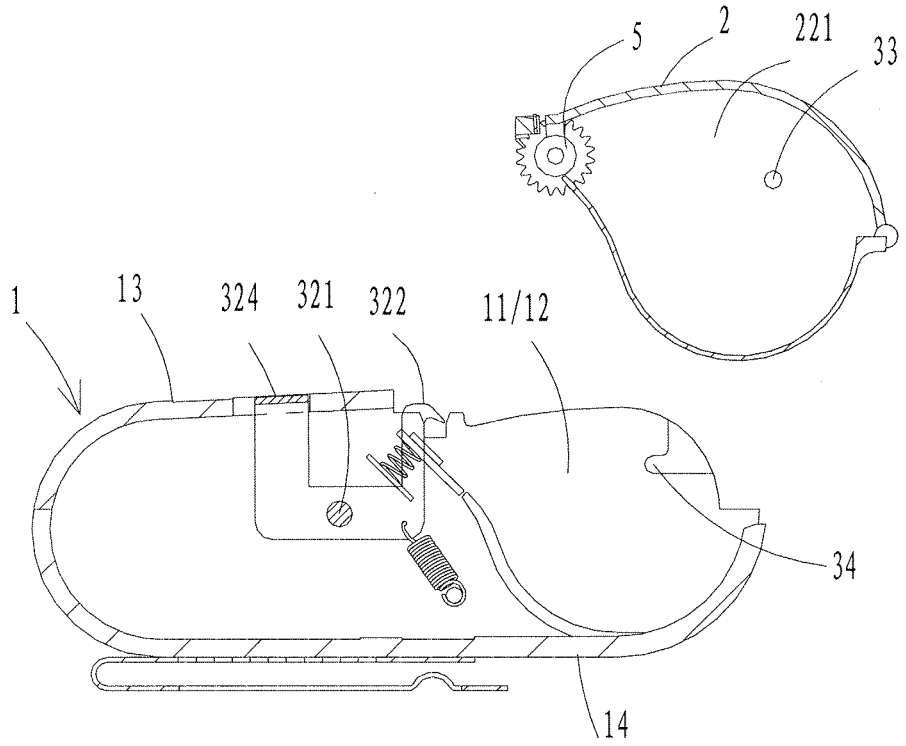
FIG. 12 is a first view of installing of a paper storage into a printer according to a third embodiment of the present disclosure.
Figure 13:
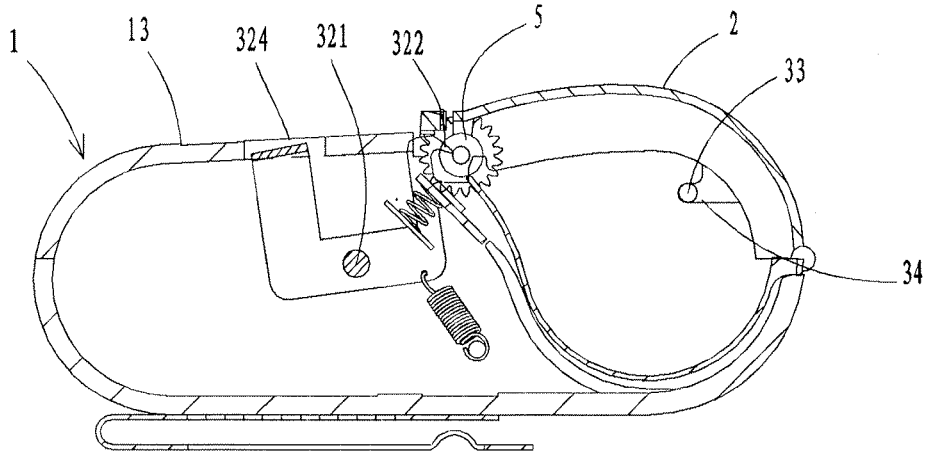
FIG. 13 is a second view of installing of a paper storage into a printer according to the third embodiment of the present disclosure.

FIG. 12 is a first view of installing of a paper storage into a printer according to a third embodiment of the present disclosure, and FIG. 13 is a second view of installing of a paper storage into a printer according to the third embodiment of the present disclosure. As shown in FIG. 12 and FIG. 13, the printer and the paper storage provided in the present embodiment differ from the previous embodiments in that: the first connection member of the paper storage 2 in the present embodiment includes two clamping parts 33, which are respectively arranged at the outer sides of the left side wall 221 and the right side wall 222 of the chassis 22 and located at a side away from the opening 224; and the third connection member of the printer includes two clamping slots 34, which are correspondingly arranged on the inner surfaces of the left wall 11 and the right wall 12 of the base, and have a depth extending in the thickness direction of the walls.

In installing the paper storage 2, the clamping parts 33 on the paper storage 2 enter into the openings of the clamping slots 34 on the left wall 11 and the right wall 12, and when the clamping parts 33 reach the bottoms of the clamping slots 34, the paper storage 2 is rotated so that the core shaft 51 of the roller 5 enters into the opening of the notch 16 and matches with the lock hooks 322 in a clamping manner, thereby fixing the position of the paper storage 2 relative to the base 1. In detaching the paper storage 2, the button 324 is firstly triggered or pressed so that the lock hooks 322 are separated from the core shaft 51 of the roller 5, then the paper storage 2 is rotated about the clamping parts 33 to lift up the front end of the paper storage 2, and finally paper storage 2 is moved along the longitudinal direction of the clamping slots 34 to detach the paper storage 2 from the base 1.

The present disclosure also provides a method of using multiple types of mediums. Herein, a medium processing system is provided and includes one medium processing device and a plurality of paper storages. To utilize a different type of medium, a paper storage accommodating this type of medium is combined with the base of the medium processing device, where the medium is discharged from the medium outlet of the paper storage after passing by the roller of the paper storage, and the medium processing device matches with the roller via the opening of the paper storage for the purpose of processing the medium.

Preferably, the medium processing system is a printing system, and the medium processing device is a printer.

The above medium processing system is advantageous in that: depending on different types of medium processing operations such as the printing operations and scanning operations, paper storages accommodating different mediums may be selectively adopted, and the replacement of the medium is very convenient and rapid.

Some preferred embodiments of the present disclosure have been described as above, but the scope of the present disclosure is not limited thereto, and various modifications and alternations may be made to the present disclosure by those of ordinary skills in the art. Any modifications, equivalent replacements and improvements made without departing from the spirit and principles of the present disclosure fall within the scope of the present disclosure.

The invention claimed is:

1. A paper storage comprising: a storage body (20) for accommodating a medium, a medium outlet (A), and a roller (5) arranged on the storage body (20), wherein the medium outlet (A) is configured to discharge the medium accommodated in the storage body (20) after the medium passes by the roller (5), and an opening (224) opposite to the roller (5) is provided on a wall of the storage body (20), to allow an external medium processing device to match with the roller (5) through the opening (224) to process the medium;

wherein the paper storage (20) comprises a chassis (22) and an upper cover (21), and the chassis (22) and the upper cover (21) are combined to form the medium outlet (A);

wherein the roller (5) is arranged on the upper cover (21) and the opening (224) is arranged on the chassis (22).

2. The paper storage of claim 1, further comprising a paper tearing bar (23) located at the medium outlet (A) and arranged on the chassis (22).

3. The paper storage of claim 1, wherein a guide member (25) configured to limit a position of the medium in a width direction is arranged in the storage body (20).

4. The paper storage of claim 1, further comprising a clamping structure configured to lock the upper cover (21) and the chassis (22) together when the upper cover (21) is closed relative to the chassis (22).

5. The paper storage of claim 1, wherein the upper cover (21) is pivoted with or detachably connected with the chassis (22).

6. The paper storage of claim 1, wherein a gear (53) in a transmission connection with a driving mechanism of the external medium processing device is arranged at an axial end of the roller (5).

7. The paper storage of claim 1, further comprising a connection structure configured to connect the storage body (20) with the external medium processing device.

8. A printer, comprising a base (1) and a detachable paper storage (2), the detachable paper storage comprises a storage body (20) for accommodating a medium, a medium outlet (A), and a roller (5) arranged on the storage body (20), wherein the medium outlet (A) is configured to discharge the medium accommodated in the storage body (20) after the medium passes by the roller (5), and an opening (224) opposite to the roller (5) is provided on a wall of the storage body (20), to allow an external medium processing device to match with the roller (5) through the opening (224) to process the medium;

wherein a printing head assembly (4) is arranged on the base (1), and the roller (5) of the detachable paper storage (2) is configured to match with a printing head (41) of the printing head assembly (4) at the opening (224) of the paper storage (2).

9. The printer of claim 8, wherein the base (1) is provided with a driving mechanism configured to drive the roller (5) to rotate.

10. The printer of claim 8, wherein the base (1) is provided with a concave portion (17) configured to position the paper storage (2).

11. The printer of claim 10, wherein a first elastic element (8) declining toward the paper storage (2) is arranged in the concave portion (17) so that the paper storage (2) always trends to move away from the concave portion (17).

12. The printer of claim 8, wherein a clamping structure configured to clamp the paper storage (2) and the base (1) together is arranged between the paper storage (2) and the base (1).

13. The printer of claim 8, wherein a locking mechanism configured to lock the paper storage (2) is further arranged on the base (1), and the locking mechanism comprises a lock hook (322) configured to match with a core shaft (51) of the roller (5) on the paper storage (2) in a locking manner.

14. A printer, comprising a base (1) and a paper storage (2) detachably connected with the base (1), wherein the paper storage (2) comprises a chassis (22) and an upper cover (21) which are pivoted with each other through a pivot shaft (211), wherein the upper cover (21) is rotatable to be opened or closed relative to the chassis (22), a roller (5) is arranged on the upper cover (21), and an opening (224) is arranged on the chassis (22), a printing head assembly (4), a driving mechanism configured to drive the roller (5) to rotate, and a concave portion (17) configured to accommodate the paper storage (2) are arranged on the base (1), a clamping slot (34) configured to clamp the pivot shaft (211) is arranged in the concave portion (17), and a lock hook (322) configured to lock a core shaft (51) of the roller (5) is arranged on the chassis (1), wherein a space configured to accommodate a medium is formed between the upper cover (21) and the chassis (22) when the upper cover (21) is closed relative to the chassis (22), and the roller (5) matches with a printing head (41) of the printing head assembly (4) at the opening (224).

* * * * *